United States Patent [19]

Schmeykal et al.

[11] Patent Number: 4,932,799

[45] Date of Patent: Jun. 12, 1990

[54] TYPEWRITER OR SIMILAR MACHINE

[75] Inventors: Rudolf Schmeykal, Hemhofen; Johannes Haftmann, Schwabach, both of Fed. Rep. of Germany

[73] Assignee: TA Triumph-Adler Aktiengesellschaft, Nuremberg, Fed. Rep. of Germany

[21] Appl. No.: 227,534

[22] Filed: Aug. 1, 1988

[30] Foreign Application Priority Data

Sep. 2, 1987 [DE] Fed. Rep. of Germany ..... 3729307

[51] Int. Cl.[5] ..... B41J 19/70

[52] U.S. Cl. ..... 400/187; 400/314.1; 400/322; 400/572

[58] Field of Search ..... 400/314, 314.1, 185, 400/187, 572, 322, 323; 318/115

[56] References Cited

U.S. PATENT DOCUMENTS

| | | | |
|---|---|---|---|
| 890,867 | 6/1908 | McLaughlin | 400/572 |
| 3,438,477 | 4/1969 | Foersterling | 197/114 |
| 4,030,588 | 6/1977 | Hawagata et al. | 400/185 |
| 4,099,106 | 7/1978 | Nikaido | 318/115 |
| 4,218,151 | 8/1980 | Kondur, Jr. | 400/314.1 |
| 4,234,831 | 11/1980 | Kemmer et al. | 318/115 |
| 4,444,521 | 4/1984 | Rickard et al. | 400/185 |
| 4,752,786 | 6/1988 | Inoue et al. | 400/185 |
| 4,772,898 | 9/1988 | Noda | 400/314 |

FOREIGN PATENT DOCUMENTS

| | | | |
|---|---|---|---|
| 2059154 | 6/1971 | Fed. Rep. of Germany . | |
| 3243792 | 9/1983 | Fed. Rep. of Germany | 400/185 |
| 3538017 | 4/1987 | Fed. Rep. of Germany . | |
| 3618371 | 12/1987 | Fed. Rep. of Germany . | |
| 108178 | 6/1983 | Japan | 400/572 |

OTHER PUBLICATIONS

Brown, "Indexing System with Improved Cam Control", *IBM Technical Disclosure Bulletin*, vol. 23, No. 8, Jan. 1981, pp. 3770-3771.

Arter et al., "Stepping Motor with Shaft to Translation", *IBM Technical Disclosure Bulletin*, vol. 26, No. 4, Sep. 1983.

*Primary Examiner*—Paul T. Sewell

*Attorney, Agent, or Firm*—Browdy & Neimark

[57] ABSTRACT

A typewriter or similar machine having a platen turnable by means of a ratchet and a line spacing wheel and a carriage movable along the platen by means of a pulling means, on which a typing element or push button is disposed. In accordance with the invention a so-called lift-rotation motor is used for turning the platen, for line spacing and for moving the carriage. Its turning movement is transferred to the carriage by a pulling means. The axial movement of the motors causes the pivoting of a ratchet support on which the spacing ratchet is disposed which turns the platen by means of a toothed spacing wheel. In this way no additional motor for one of the two functions is required. The lift and rotary movement of the motor can take place temporally superimposed. In this way no time delays occur in the course of operation of the typewriter or of a printer.

2 Claims, 1 Drawing Sheet

TYPEWRITER OR SIMILAR MACHINE

BACKGROUND OF THE INVENTION

1. Field of the Invention

The invention relates to a typewriter or similar machine having a platen turnable by means of a ratchet and a line spacing wheel and a carriage movable along the platen by means of a pulling means, on which a typing element or push button is disposed.

2. The Prior Art

Normally separate driving means are utilized for the platen as well as for the carriage; in more recent machines these driving means are step motors. The latter have generally proven themselves. However, they are expensive and furthermore require comparatively expensive control electronics.

A typewriter is known from German Published, Non-Examined Application DE-OS No. 20 59 154 in which the carriage movement, the turning adjustment of the type wheel and the line spacing are driveable by one single motor. However, this known device requires extensive mechanical transfer means. Furthermore, additional control magnets are required for activating certain functions driven by the motor. Furthermore, it is doubtful whether a typewriter of high quality can be manufactured in accordance with this known proposal. Additionally, only very low typing speeds could be attained with the known device, because the drive must be switched from type wheel adjustment to carriage movement. Inversely, this function must be disconnected after the carriage movement before the type wheel can be set to a new position.

SUMMARY OF THE INVENTION

It is an object of the invention to provide a perfectly operating drive by means of a single motor for movement of the platen for the purpose of line spacing or insertion or removal of paper as well for movement of the carriage on which the typing element or a push button is disposed. Suitable for this is a design of the drive wherein the drive for the spacing ratchet and the pulling means is in the form of a lift-rotation or reciprocation-rotation motor. Reciprocation-rotation motors of this type are known, for example, from German Published Non-Examined Application DE-OS No. 35 38 017. Such a motor is particularly suitable if it is in the form of a step motor, because with the aid of the pulling means, for example a toothed belt, the carriage can be set to the exact print position. This poses no problems in the typewriters current in use today. In accordance with the invention, the axial movement of the motor shaft is utilized for the pivot movement of the line spacing ratchet. The design can be such that the length of the axial movement determines the pivot angle of the platen. In this case the setting of the line spacing would have an effect on the motor control program. However, it is also possible to maintain an even axial lift of the motor shaft and to pre-set the size of the pivot angle of the typewriter by mechanical means. It is to be understood that the structural design of the device must be such that the drive wheel for the pulling means does not follow the axial lift movement of the motor shaft.

A preferred embodiment of the line spacing ratchet and its support is provided such that the motor shaft acts on a pivotable ratchet carrier, on which the spacing ratchet for the line spacing wheel is also pivotably disposed, a spring being fastened between the ratchet carrier and the spacing ratchet. The above described attainment of the object of the invention has the advantage of needing only a single drive for two completely different functions. Besides a savings in weight there is a considerable savings in cost and the requirement for components is also reduced. The mechanical control effort is also kept within limits so that, considered as a whole, a typewriter or printer can be manufactured more cost-effectively.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWING

The invention of the present application will now be described in more detail with reference to the preferred embodiments of the device, given only by way of example, and with reference to the accompanying drawings, in which.

DETAILED DESCRIPTION OF THE PREFERRED EMBODIMENT

Figure 1:
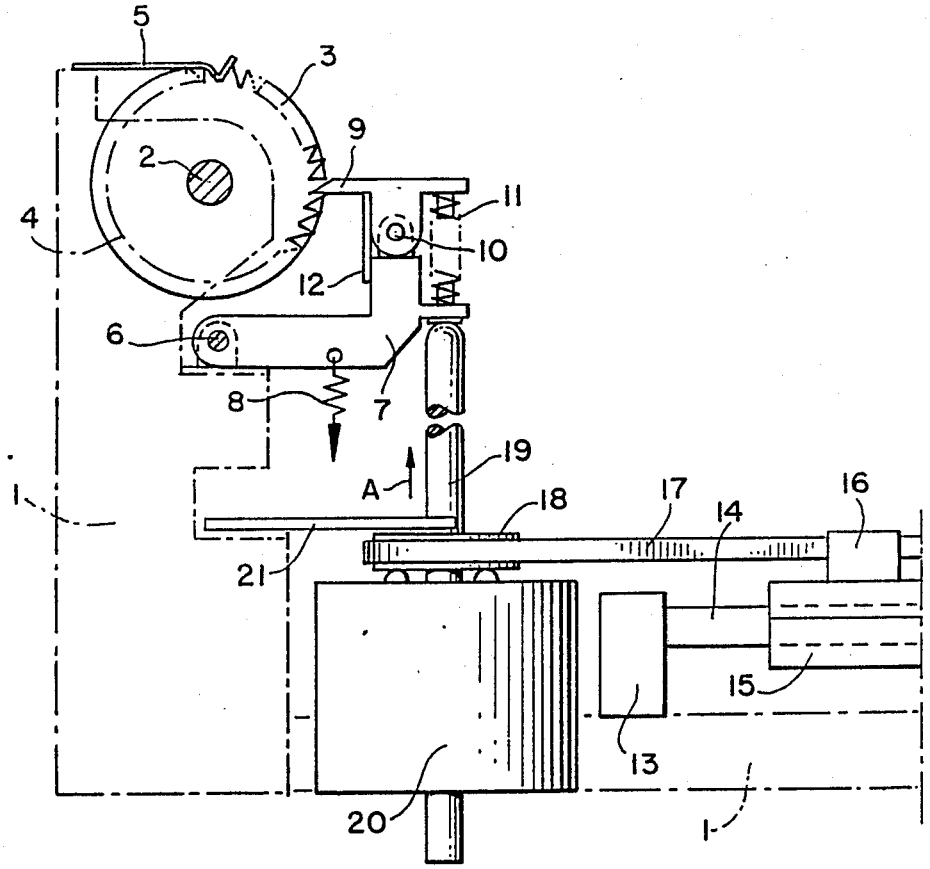
FIG. 1 illustrates a schematic representation of the side view of the platen drive according to an exemplary embodiment of the invention.

In FIG. 1, the drive for the carriage is shown at the dash-dotted break line turned at a 90° angle. This manner of representation was chosen for reasons of simplicity of the drawing. It is therefore necessary to imagine the drive of the carriage or the position of its guide rail as extending into the drawing plane parallel to the platen axis.

The machine frame 1 is only shown by dash-dotted lines. The platen 3 is pivotably disposed on a shaft 2 in the machine frame 1. A toothed line spacing wheel 4 is mounted coaxially with shaft 2 so as to be pivotable with the shaft. To prevent the unintentional turning of the platen, the line spacing wheel 4 is secured by means of a locking spring 5. As is customary, the line spacing wheel 4 is provided with gear teeth. A so-called line spacing wheel clutch (push-in platen) may be provided between the line spacing wheel 4 and the platen 3. Also disposed in the machine frame 1 pivotable around a pin 6 is the ratchet support 7, on which a spring 8 can act. The latter biases support 7 to maintain the ratchet support 7 in its lower position of rest. Seen from the side, the spacing ratchet 9 which cooperates with the line spacing wheel 4 is approximately T-shaped and is pivotably supported at 10 on the ratchet support 7. A spring 11 acts on the other end of the T-shaped ratchet 9 and biases ratchet 9 to maintain the spacing ratchet 9 in the position shown. A movement limiter 12 abuts the ratchet support 7 and thus limits the action of the spring 11.

A support 13 for the guide rail 14 of the carriage 15 is also disposed on the machine frame 1. A typing element, for example a type wheel with a rotary setting motor or a push button can be disposed on the carriage. A receiver 16 for a pulling means 17 is disposed on the carriage. This may be in the form of, for example, a toothed belt which is guided around correspondingly toothed wheels, also pivotably fixed on the machine frame 1. It is also possible to use a cable which is wound on a cable drum.

In the illustrated exemplary embodiment the pulling means 17 is a toothed belt which is guided around a toothed wheel 18. The other side of the machine cannot be seen from the drawing. The toothed wheel 18 is seated on the shaft 19 of the lift-rotation motor 20. A bar 21 fastened on the machine frame 1 insures that the toothed wheel 18 does not follow the axial movement of the motor shaft 19.

For moving the carriage 15 the reciprocation-rotation motor 20 is provided with power so that its rotor turns. The rotary movement is transferred to the pulling means 17 by way of the toothed wheel 18, so that the carriage 15 is moved, for example step by step from printing position to printing position. If the direction of rotation of the motor 20 is reversed, the carriage 15 returns, for example, to the left margin.

For the purpose of line spacing, which can be accomplished temporally superimposed on the carriage movement, the motor shaft 19 is axially displaced. In accordance with a set power supply scheme the lifting or axial motion takes place in the direction of the arrow A. The ratchet support 7 is pivoted against the force of the spring 8 and the spacing ratchet 9 turns the spacing wheel 4 and thus the platen 3 by the preset amount. During the reverse movement of the motor shaft 19, the spring 8 pulls the ratchet support and with it the spacing ratchet 9 back into its original position. The spacing ratchet 9 slides across the teeth of the spacing wheel 4. When the spacing ratchet 9 is being moved downward, the joint 10 and the spring 11 make it possible for the spacing ratchet 9 to slide across the teeth of the line spacing wheel 4.

As previously mentioned, the line spacing can be set. This can either be done mechanically or by means of a microprogram which subsequently puts out a set power scheme for the axial movement of the motor shaft 19. This means that the amount of the lift or axial movement of the motor shaft 19 determines the size of the pivot angle of the platen 3. Thus the line spacing can be set to one, one-and-a-half, two, etc. lines. The locking spring 5, which also engages the line spacing wheel 4, prevents an unintended turning of the platen 3. In particular, at the time the spacing ratchet 9 slides across the teeth of the line spacing wheel 4 it positively prevents the unintended movement of the latter and of the platen 3 with it.

As shown in the drawing two functions differing from each other, namely line spacing and carriage movement, are accomplished by comparatively simple and thus cost-effective means with the use of a single drive.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A typewriter or similar machine including a frame, comprising:

a platen disposed in the frame;

a spacing ratchet and a line spacing wheel for turning said platen;

a movable carriage including a typing element means;

pulling means for pulling said carriage along said platen; and a reciprocation-rotation motor operatively connected to said spacing ratchet and said pulling means, said motor having a shaft adapted to independently move rotationally and axially, said shaft connected to said pulling means such that rotational movement of said shaft causes the pulling of said carriage, and said shaft connected to said spacing ratchet such that axial movement of said shaft causes the turning of said platen.

2. The typewriter in accordance with claim 1, further comprising:

a ratchet support for supporting said spacing ratchet for said line spacing wheel, said support being pivotable mounted on the frame; and spring mounted between said ratchet support and said spacing ratchet for biasing said spacing ratchet so as to move said spacing ratchet across said line spacing wheel and thus rotate said platen.

* * * * *